US008650789B2

(12) United States Patent
Dionne et al.

(10) Patent No.: US 8,650,789 B2
(45) Date of Patent: Feb. 18, 2014

(54) FIREARM SELECTOR SWITCH LOCKING APPARATUS

(71) Applicant: Megamet Solid Metals, Inc, Earth City, MO (US)

(72) Inventors: Bruce Dionne, Crestwood, MO (US); Michael Borrini, Rock Hill, MO (US)

(73) Assignee: Megamet Solid Metals, Inc., Earth City, MO (US)

( * ) Notice: Subject to any disclaimer, the term of this patent is extended or adjusted under 35 U.S.C. 154(b) by 0 days.

(21) Appl. No.: 13/671,158

(22) Filed: Nov. 7, 2012

(65) Prior Publication Data

US 2013/0111795 A1 May 9, 2013

Related U.S. Application Data

(60) Provisional application No. 61/556,524, filed on Nov. 7, 2011.

(51) Int. Cl.
*F41A 17/02* (2006.01)

(52) U.S. Cl.
USPC ..... 42/70.11; 41/70.01

(58) Field of Classification Search
USPC ..... 42/70.01, 70.11
See application file for complete search history.

(56) References Cited

U.S. PATENT DOCUMENTS

| | | | | |
|---|---|---|---|---|
| 2,342,283 | A | 2/1944 | Hyde | |
| 3,258,871 | A | 7/1966 | Green | |
| 3,882,622 | A * | 5/1975 | Perlotto | 42/70.11 |
| 3,924,512 | A | 12/1975 | Fagg | |
| 4,523,510 | A | 6/1985 | Wilhelm | |
| 5,231,236 | A | 7/1993 | Del Real et al. | |
| 5,361,525 | A | 11/1994 | Bowes | |
| 6,141,896 | A * | 11/2000 | Oberst | 42/70.06 |
| 6,173,518 | B1 * | 1/2001 | Oberst | 42/70.06 |
| 6,256,917 | B1 * | 7/2001 | Findlay | 42/70.06 |
| 6,347,538 | B1 * | 2/2002 | Doiron | 70/58 |
| 6,389,728 | B1 * | 5/2002 | Lundy | 42/70.11 |
| 6,510,641 | B1 | 1/2003 | Viani | |
| 6,550,176 | B2 | 4/2003 | Beretta | |
| 7,243,453 | B2 | 7/2007 | McGarry | |
| 7,726,059 | B2 * | 6/2010 | Pikielny | 42/70.11 |
| 2007/0180984 | A1 | 8/2007 | Huther | |
| 2008/0216376 | A1 * | 9/2008 | Pikielny | 42/70.11 |
| 2010/0132541 | A1 | 6/2010 | Hochstrate et al. | |

* cited by examiner

*Primary Examiner* — Jonathan C Weber

(74) *Attorney, Agent, or Firm* — Polster, Lieder, Woodruff & Lucchesi, L.C.

(57) ABSTRACT

A lockable safety selector switch adapted to replace a manufacturer's original safety selector switch for a firearm having a selector detent pin with a tip. The lockable safety selector switch has a body adapted to selectively orient between a SAFE position that prevents the firearm from firing and a FIRE position that allows the firearm to fire, and a locking mechanism configured to operatively associate with the firearm selector detent pin to selectively lock the body in the SAFE position. The lockable safety selector switch is configured such that the firearm requires no modification for the lockable safety selector switch to replace the original safety selector switch.

20 Claims, 7 Drawing Sheets

FIREARM SELECTOR SWITCH LOCKING APPARATUS

CROSS REFERENCE TO RELATED APPLICATIONS

This application claims the benefit of U.S. Provisional Application No. 61/556,524, entitled RIFLE RECEIVER SELECTOR SWITCH LOCKING APPARATUS AND METHOD, filed on Nov. 7, 2011. The disclosure of the above application is incorporated herein by reference.

STATEMENT REGARDING FEDERALLY SPONSORED RESEARCH OR DEVELOPMENT

Not applicable.

BACKGROUND OF THE INVENTION

This invention relates principally to a lockable firearm safety selector switch, and more particularly to a novel lockable firearm selector switch that is capable of replacing the non-lockable safety selector switch in the receiver of an AR15 rifle or other similar designs, while requiring no modifications to the firearm receiver.

It has become increasingly important for the purposes of theft prevention and public safety, to hinder the rapid use of a firearm that is otherwise in a stored condition. At least from a public perception standpoint, this has become particularly important for semiautomatic and assault weapon firearms. While no system is foolproof, a device or system that at least deters the rapid deployment and use of a firearm that would otherwise be amenable to such use is desirable.

One pervasive and very successful assault weapon widely distributed in the worldwide market is the fully automatic M16 rifle and its semiautomatic (civilian or sport) version, the AR15. Millions of these rifles and their variants have been produced and continue to be produced and utilized throughout the world. One significant aspect of these rifles is the designed and specified interchangeability of the rifle's individual components, and each manufacturer of the AR15 must produce its rifles to meet these interchangeability specifications. That is, the rifle has been designed for maximum interchangeability of the vast majority of the rifle components such that, for example, a trigger assembly from one AR15 can be utilized in a different AR15 simply by swapping the components between the two firearms. With particular regard to the present invention, the AR15 share a common and interchangeable set of safety selector switches. Each AR15 has a safety selector switch. Unfortunately, none of the original equipment manufacturer ("OEM") safety selector switches are lockable.

It is desirable, therefore, to devise a safety selector switch for a firearm, and in particular for an AR15 rifle, that is interchangeable with the OEM safety selector switch. In addition, it is further desirable to devise such a lockable safety selector switch that requires no modification to the firearm's receiver to either install or operate.

While the preferred embodiment of the present invention is directed to a lockable safety selector switch for an AR15 rifle, the invention is equally applicable to other models firearms, both rifles and hand guns.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
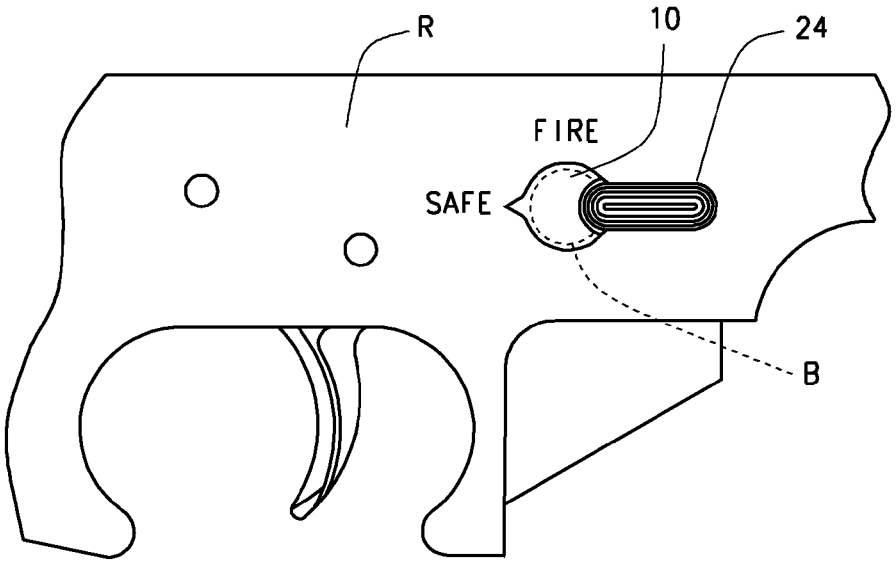
FIG. 1 is a side view of portion of a receiver of a firearm having a lockable safety selector switch of one embodiment of the present invention.
Figure 2:
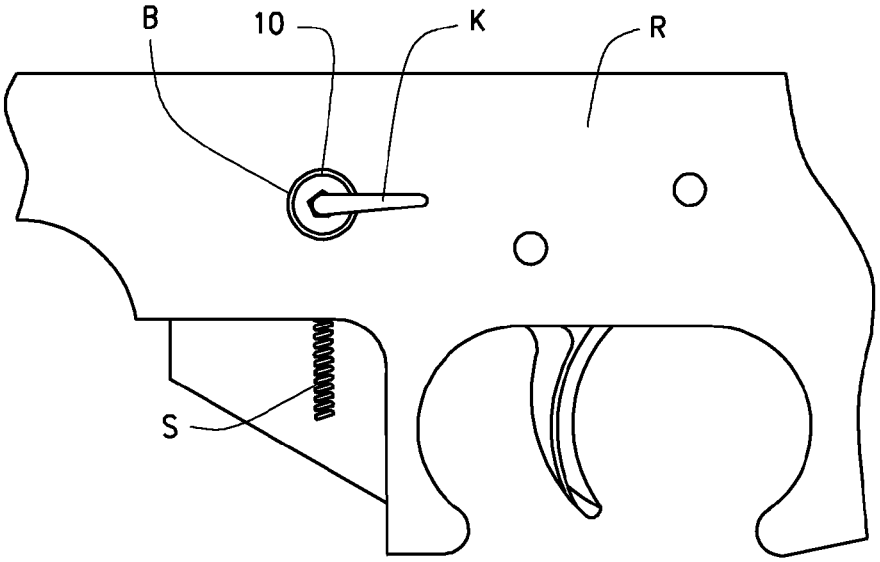
FIG. 2 is a side view opposite of FIG. 1 of a portion of a receiver of a firearm having a lockable safety selector switch of one embodiment of the present invention, and having a key engaged with the switch.

In referring to the drawings, an embodiment of the novel lockable safety selector switch 10 for a receiver R (FIGS. 1, 2) of a firearm, such as for example an AR15, of the present invention is shown generally in FIGS. 3-13, where the present invention is depicted by way of example, and is shown in FIGS. 3-5 and 10-13 to interact with a firearm selector detent pin P having a tip T associated with a compression spring S, and with a trigger arm A (FIGS. 5, 12-13), which are all located within the receiver R. As can be seen, the switch 10 comprises a switch body 12, a movable detent 14, a detent positioning cam 16 and an assembly cap 18, the components inside the body 12 comprising a locking mechanism. The switch body 12 is configured to match where necessary the outer surface configuration of the firearm manufacturer's original standard, or "spec", selector switch for a desired firearm; here, an AR15. This facilitates the replacement of a standard selector switch with a novel lockable safety selector switch 10 of the present invention without any modification to the firearm or the switch 10. However, while a standard selector switch is typically solid metal, the selector switch 10 of the present invention is hollow and comprises locking components contained within the switch body 12 to facilitate its locking function.

Figure 3:
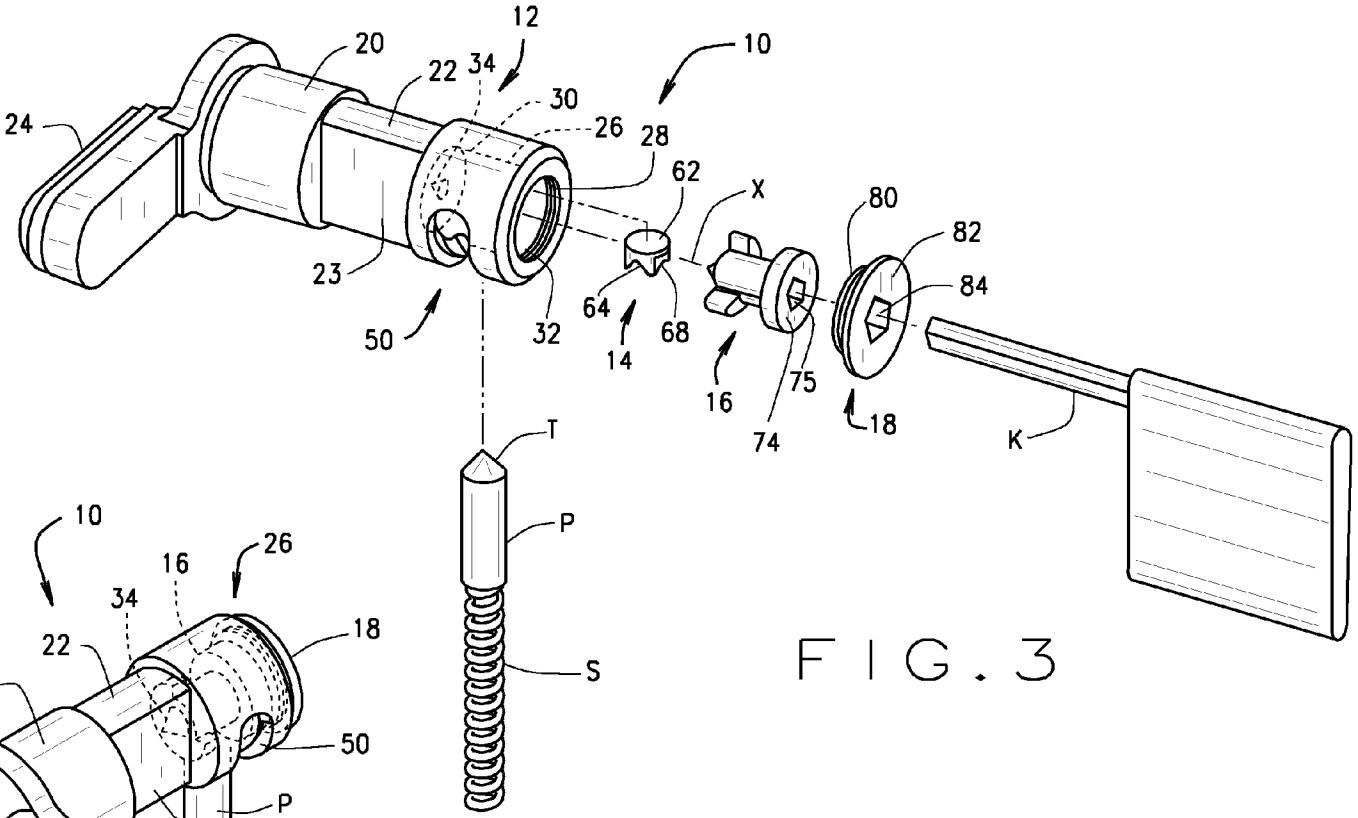
FIG. 3 is an exploded partially transparent perspective view of a lockable safety selector switch of one embodiment of the present invention, showing the interaction of a key and a firearm selector detent pin with the selector switch.

Referring to FIG. 3, the switch 10 comprises a cylindrical shaft 20 having a central axis X. A coaxial generally cylindrical central portion 22 that is coaxial with but has a diameter slightly less than the shaft 20 extends approximately along the central third of the shaft 20. The central portion 22 has a flat surface 23 along one side. A lever 24 extends laterally from one end of the shaft 20, and is configured to allow the firearm operator to rotate the switch 10 about the axis X when the switch 10 is properly positioned within the receiver R of a firearm. Opposite the lever 24, a cylindrical bore 26, also having its central axis at X, extends approximately one third of the way into the shaft 20. The bore 26 has an open distal end 28 and a closed proximal end 30 and is configured to house the cam 16 freely rotatable there within. The bore 26 does not extend into the central portion 22. Female threads 32 are formed in the distal end 28 of the bore 26. Further, a small conical bore 34 (FIGS. 3-4, 12-14), centered upon and coaxial with the axis X, extends from the proximal end 30 of the bore 26 further into the shaft 20 in the direction of the lever 24, the conical bore 34 having its apex directed away from the bore 26. In addition, a plug or other cover (not shown) can be fashioned of rubber or some other suitable material such that the plug or cover can be removably secured in the cap 18 to seal the interior of the switch body 12 from the elements, including dust, grime and moisture.

A radial arcuate slot 50 (FIGS. 3-5) is formed in a portion of the shaft 20 near the distal end 28 of the bore 26. The slot 50 has a generally concave profile that extends for a distance of approximately one fourth the circumference of the shaft 20. The slot 50 terminates at one end at a generally cylindrical throughbore 52 and at the other end at a concave depression 54, where the outer diameters of the bore 52 and the upper edge of the depression 54 are both equal to the width of the slot 50, and there between form an arcuate groove 56 along the bottom of the slot 50. Further, the bore 52 and depression 54 align with the slot 50 such that the upper edge of the slot 50 smoothly integrates into the upper edges of the bore 52 and the depression 54. The bore 52 penetrates from the outer surface of the shaft 20 through to the bore 26 and has parallel ledges 53 formed on opposing sidewalls below the level of the slot 50. The depression 54, though not a throughbore, extends further into the shaft 20 than the groove 56. The width of the slot 50 is such that the slot 50 can closely yet freely receive the tip T of the selector detent pin P at any position along the full length of the slot 50 when the switch 10 is properly installed in the receiver R (see FIGS. 2, 12-13), and the selector detent pin P can closely yet freely extend into either of the throughbore 52 or the depression 54.

Figure 5:
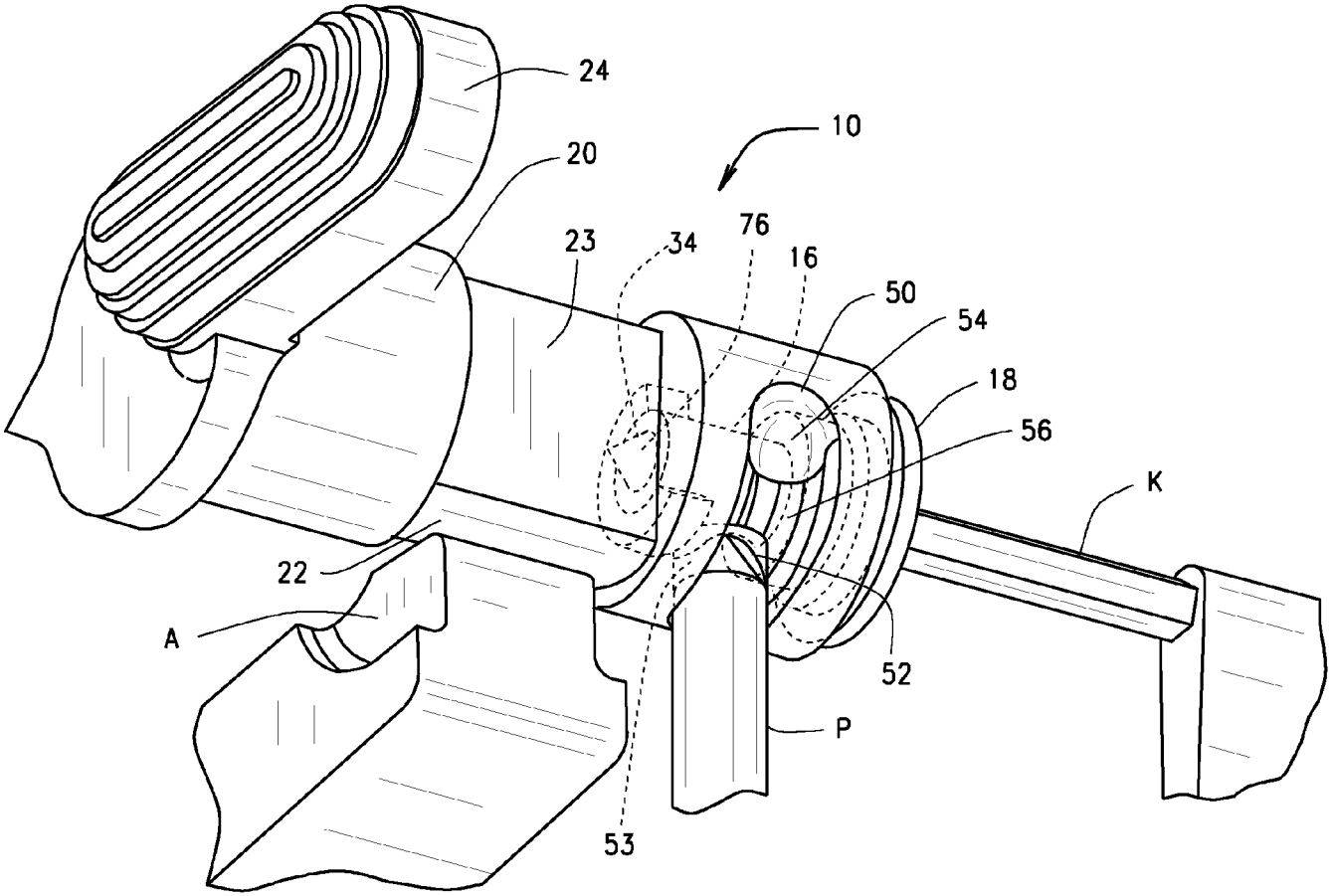
FIG. 5 is another partially transparent perspective view of the lockable safety selector switch of FIG. 3 in a fully assembled condition, showing the selector switch engaged with a key, a firearm selector detent pin and a firearm trigger arm.
Figure 6:
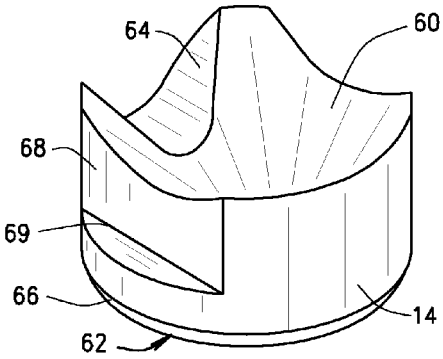
FIG. 6 is a perspective view of the movable detent of the lockable safety selector switch of FIG. 3.
Figure 7:
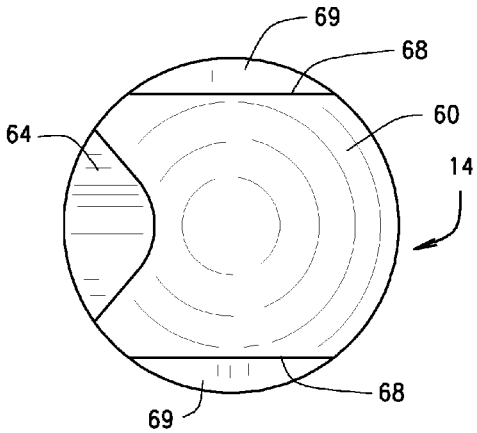
FIG. 7 is a plan view of the movable detent of the lockable safety selector switch of FIG. 3.

Referring now to FIGS. 6 and 7, it can be seen that the movable detent 14 is cylindrical, with a generally concave lower end 60 and an opposing generally flat upper end 62. A sinusoidal groove 64 along the outer edge of the lower end 60 extends from the outer surface of the movable detent 14 to the inner concave surface of the lower end 60. The groove 64 is shaped to conform to shape of the tip T of the selector detent pin P. The upper end 62 of the movable detent 14 is chamfered to form a curved rim 66 along the outer edge of the upper end 62. Two matching parallel peripheral flats 68 are formed along opposing sides of the movable detent 14, and extend from the lower end 60 to two matching and opposing and coplanar ledges 69 formed near the upper end 62. The ledges 69 are configured to mate with the ledges 53 in the bore 52 at one end of the slot 50 in the shaft 20. The flats 68 are configured to enable the movable detent 14 to fit within and slide along the curved surface of the slot 50 while the ledges 69 prevent the movable detent 14 from passing entirely through the slot 50 (see FIGS. 3-5, 12-13).

Figure 8:
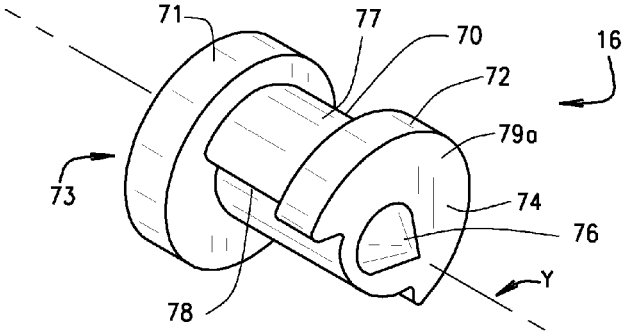
FIG. 8 is a perspective view of the detent positioning cam of the lockable safety selector switch of FIG. 3.
Figure 9:
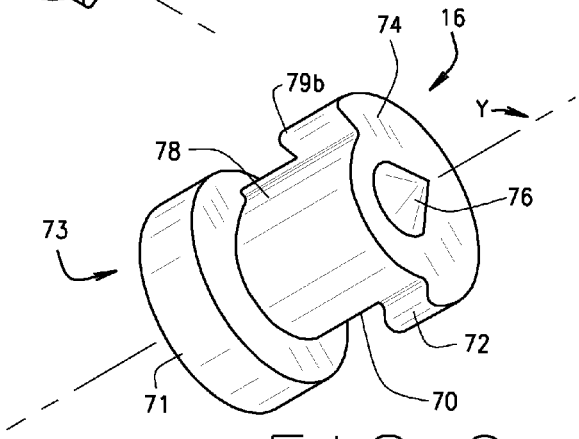
FIG. 9 is a another perspective view of the detent positioning cam of the lockable safety selector switch of FIG. 3.
Figure 10:
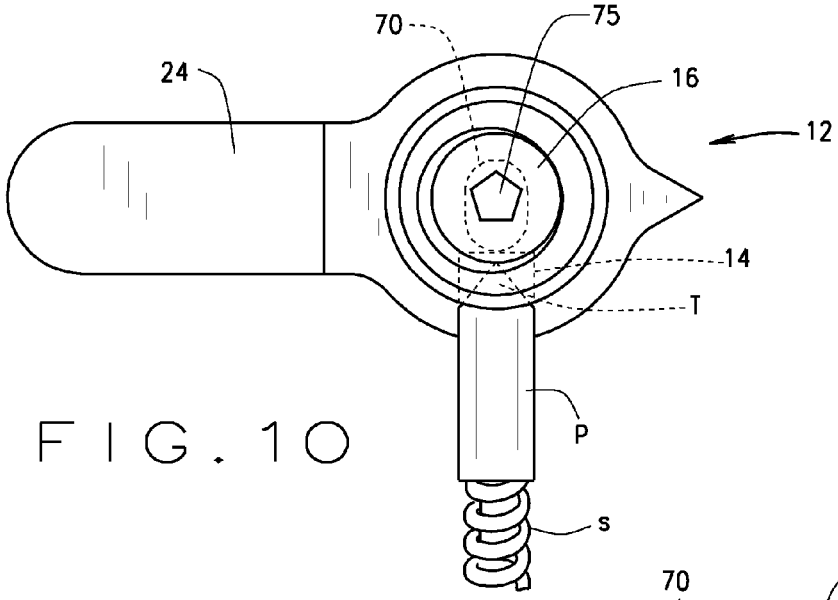
FIG. 10 is a partially transparent side view of the lockable safety selector switch of FIG. 3 in a fully assembled condition in an unlocked condition and interacting with a firearm selector detent pin.

Referring to FIGS. 8 and 9, the positioning cam 16 has the general shape of a spool with a generally cylindrical central shaft 70, and a pair of discs, 71 and 72, of equal thickness at opposing ends of the shaft 70. While the disc 71 is fully circular about its outer edge, it can be seen that the outer edge of the disc 72 traces an arcuate lip 79*a* of approximately two hundred forty degrees about the shaft 70, and thereby forms a minor arcuate portion 79*b* of the disc 72 of approximately one hundred twenty degrees about the shaft 70. The shaft 70 and the discs 71 and 72 are all coaxial about a central axis Y that runs through the center of the cam 16. The discs 71 and 72 have outer ends, 73 and 74, respectively, that are flat and parallel to each other. A key hole bore 75 extends generally into the center of the outer end 73 of the first disc 71 (FIG. 3). On the other end of the cam 16 (FIGS. 8-9), a conical detent 76 extends from of the outer end 74 of the disc 72 opposite the key hole bore 75. The conical detent 76 is coaxial with the axis Y and has a base that is smaller in diameter than the diameter of the disc 72. The conical detent 76 is configured to mate with and freely rotate within the conical bore 34 in the shaft 20 along the axis X such that when the detent 76 is engaged with the bore 34 the axis Y and the axis X are coaxial and there is little non-axial free play (see FIGS. 5, 12-13). Of course, the conical bore 34 and corresponding conical detent 76 may be configured in other shapes, such as for example, a cylindrical bore and a matching cylindrical detent, so long as the shapes provide for axial alignment of and free rotation of the detent positioning cam 16 within the cylindrical bore 26. Though generally cylindrical, the central shaft 70 is slightly spiral in cross-section such that the outer surface of the shaft forms a discrete radial ramp 77 with a single lip 78 located where the bottom of the ramp meets the top of the ramp around the shaft 70. The lip 78 is generally rectangular and stretches from the first disc 71 to the second disc 72 along the shaft 70.

The assembly cap 18 (FIGS. 3-5) is essentially a shortened screw that is utilized to close off and seal the bore 26 of the switch 10. That is, the cap 18 comprises a short threaded shaft 80 and a generally flat head 82 at one end of the shaft 80. The threaded shaft 80 is configured to mate with and screw into the female threads 32 along the inner surface at the open end of the bore 26 such that the head 82 of the cap 18 can be snugly tightened against the distal end 28 of the bore 26 in the shaft 20. The length of the threaded shaft 80 is long enough to secure the cap 18 to the distal end 28 of the bore 26, yet not so long as to compress or bind the cam 16 against the proximal end 30 of the bore 26 when the cam 16 is properly installed in the bore 26. A throughbore 84 in the cap 18 is coaxial with and extends through the shaft 80 and through the head 82. The throughbore 84 is configured to receive a shaped shaft, such as for example, an Allen wrench or a pentagonal wrench, to facilitate screwing the cap 18 into or out of the distal end 28 of the bore 26. Further, the throughbore 84 is sufficiently wide to allow a key K to pass without hindrance through the bore 84 to the key hole 75 in the cam 16.

Figure 4:
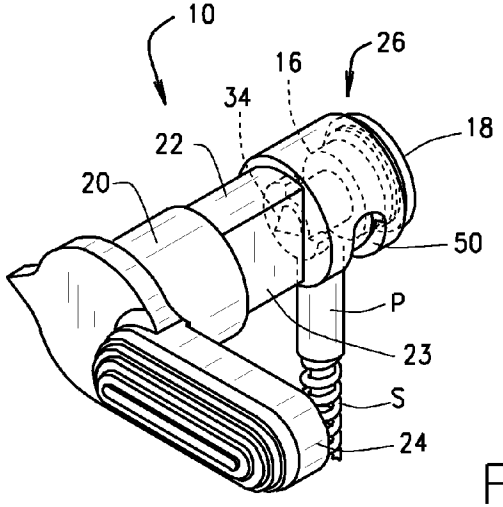
FIG. 4 is a partially transparent perspective view of the lockable safety selector switch of FIG. 3 in a fully assembled condition, and interacting with a firearm selector detent pin.

Referring to FIGS. 3-5, the switch 10 is assembled by placing the movable detent 14 through the bore 26 and into the slot 50 with the lower end 60 facing away from the axis X in the bore 26 and with upper end 62 facing toward the axis X and partially protruding into the bore 26. The dimensions of the movable detent 14 and the peripheral flats 68 are such that detent 14 cannot pass entirely through the slot 50, but that the peripheral flats 68 will align with and fit slidingly against the sidewalls of the slot 50 and that the orientation of the sinusoidal groove 64 is such that the groove 64 will align with the slot 50. In this way, the tip T of the selector detent pin P can slide along the slot 50 and into the concave lower end 60 of the movable detent 14 through the sinusoidal groove 64. The ledges 69 prevent the movable detent 14 from passing out of the bore 26 entirely through the slot 50, and thereby hold the movable detent 14 nested in the slot 50.

The cam 16 is then placed in the bore 26 such that the conical detent 73 nests within the conical bore 34 at the end of the bore 26 in the shaft 20 and the central shaft 70 aligns with the movable detent 14 and the slot 50 such that the upper end 62 of the movable detent 14 rests against the central shaft 70. The minor arcuate portion 79*b* of the disc 72 is directed generally upward away from the slot 50 and engages a small limiting detent 300 protruding from the end 30 of the bore 26. The limiting detent 300 (FIGS. 5, 14) restricts the rotation of the cam 16 within the bore 26 such that the cam 16 can only rotate along the arc defined by the non-arcuate portion of the disc 72.

The cap 18 is then screwed into the distal end 28 of the bore 26 until the cap 18 is snug. Because the key hole 75 and the bore 84 are coaxial when the switch 10 is assembled, the key hole 75 in the cam 16 is exposed through the throughbore 84 in the cap 18, allowing a user to lock or unlock the switch 10 through the cap 18. As previously explained, the short threaded shaft 80 of the cap 18 is just long enough to hold the cam 16 in the bore 26 without restricting the cam from freely rotating therein. When the switch 10 is properly assembled, the axes X and Y are substantially coaxial, and the cam 16 can rotate about its axis Y within the bore 26 and the key K can be inserted through the throughbore 84 and into the key hole 74 to facilitate such rotation.

After assembly, the switch 10 is ready to be installed in the receiver R. To do so, the selector detent pin P and its associated spring S must first be removed from the receiver R. The switch 10 is then positioned in the receiver R in place of the original OEM selector switch. (See FIGS. 1-2, 12-13). The selector detent pin P and spring S are then reinstalled in the receiver R such that the tip T of the selector detent pin P engages the slot 50 or the lower end 60 of the movable detent 14, and the spring S thereby provides a bias that holds the selector detent pin P in engagement with the switch 10. (FIGS. 3-5, 10-13). In addition, when properly installed, the trigger arm A of the receiver R, which is capable of movement in an arc from a first lower position to a second upper position within the receiver R, positively and with a bias engages the shaft 20 at either the central portion 22 or alternatively the flat surface 23, depending on the rotational orientation of the shaft 20 within the receiver R. (FIG. 5). Importantly, when the trigger arm A engages the cylindrical central portion 22, the trigger arm is not able to reach its second upper position and the firearm is consequently unable to fire and is therefore in a "SAFE" mode. In contrast, when the trigger arm A engages the flat surface 23, the trigger arm is able to reach its second upper position and the firearm is consequently able to fire and is therefore in a "FIRE" mode.

Figure 11:
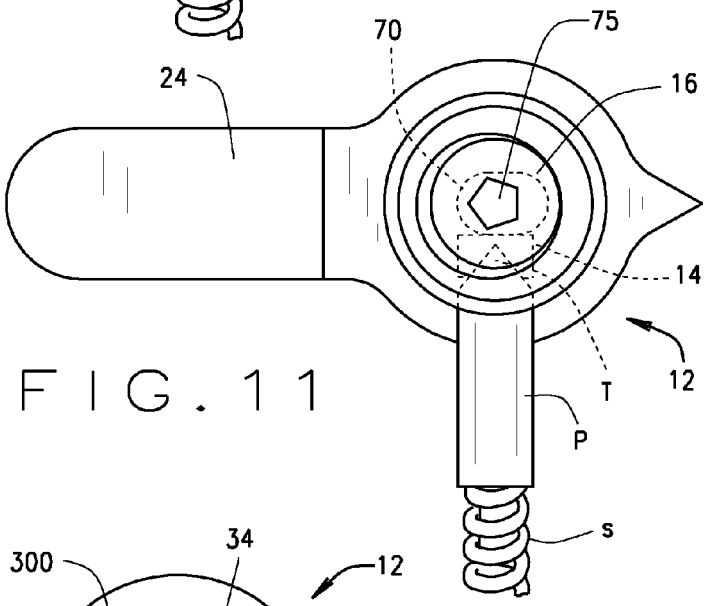
FIG. 11 is a partially transparent side view of the lockable safety selector switch of FIG. 3 in a fully assembled condition in a locked condition and interacting with a firearm selector detent pin.
Figure 14:
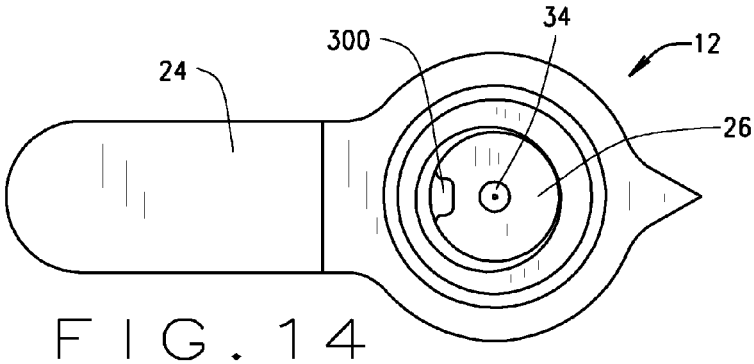
FIG. 14 is an end view of the switch body of the lockable safety selector switch of FIG. 3.
Figure 12:
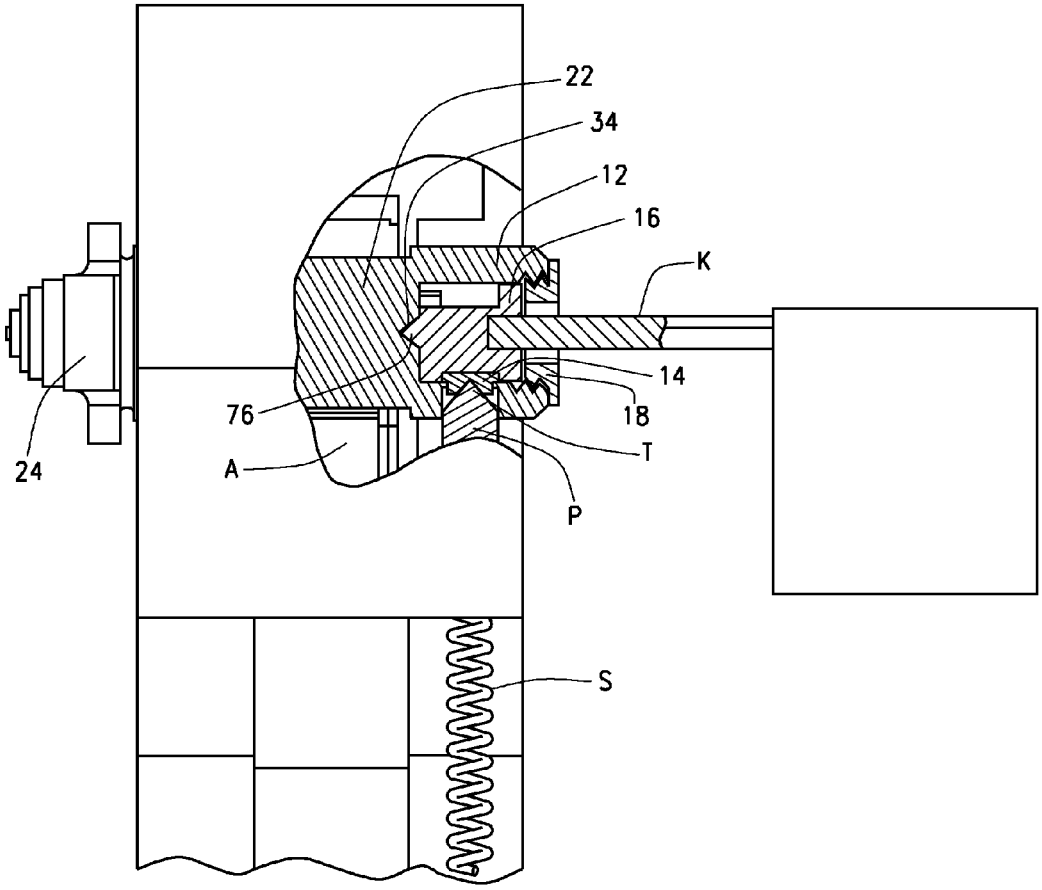
FIG. 12 is a partially cut away front sectional view of the lockable safety selector switch of FIG. 3 positioned within a firearm receiver and interacting with the firearm's selector detent pin, with an external key engaging the switch, the switch in an unlocked condition.
Figure 13:
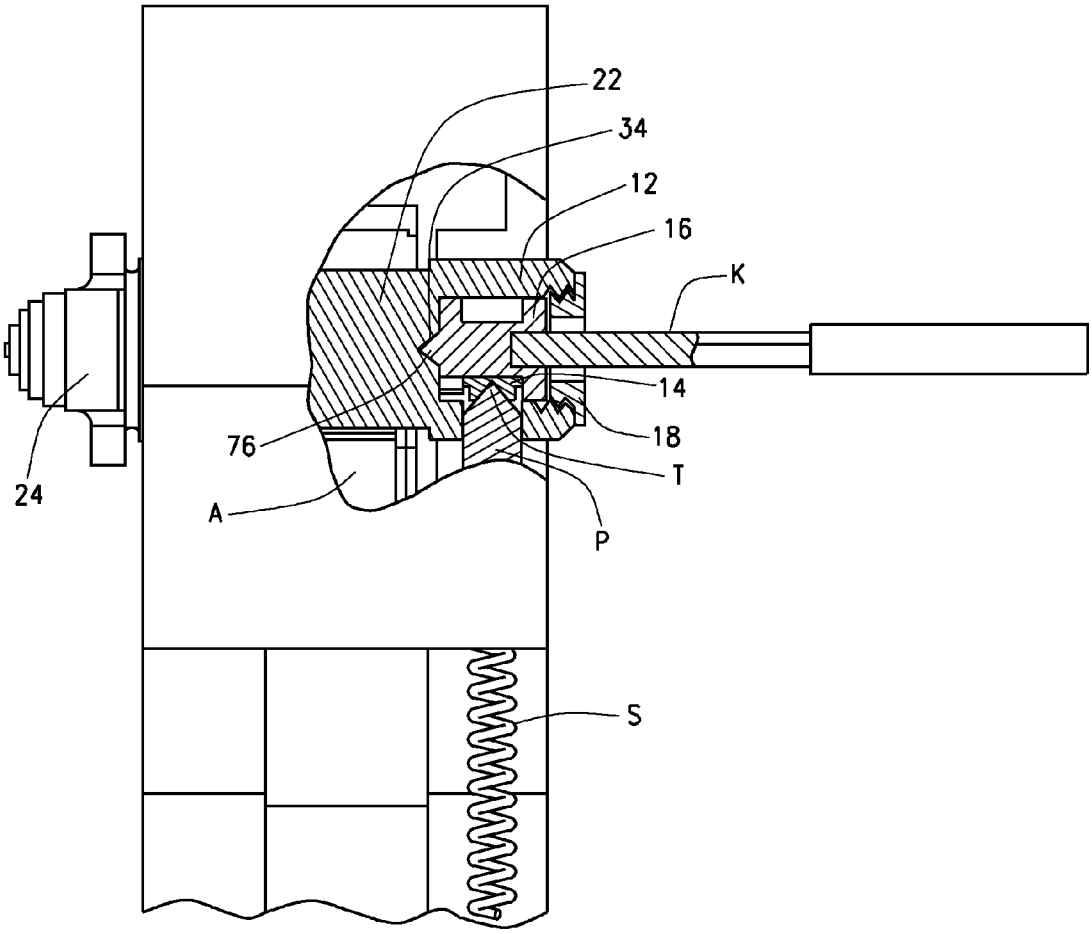
FIG. 13 is a partially cut away front sectional view of the lockable safety selector switch of FIG. 3 positioned within a firearm receiver and interacting with the firearm's selector detent pin, with an external key engaging the switch, the switch in a locked condition.

As can be appreciated, when a key K is inserted through the throughbore 84 and into the keyhole bore 75 to engage the cam 16 of a fully assembled selector switch 10 installed in the receiver R of a firearm, the key K can be used to rotate the cam 16 within the bore 26 of the selector switch 10 about the arc defined by the minor arcuate portion 79*b* of the disc 72. Because the movable detent 14 is biased upward and against the ramp surface 77 of the shaft 70 of the cam 16, the rotation of the cam 16 in one direction forces the movable detent 14 downward away from the axis Y to a first downward position at one end of the limited rotation of the cam 16 (FIGS. 10, 12), and rotation of the cam in the opposite direction allows the movable detent 14 to extend upwards toward the axis Y to a second upward position at the other end of the limited rotation of the cam 16 (FIGS. 11, 13). The cam 16 thereby acts as a tumbler within the locking mechanism of the switch 10. The displacement of the movable detent 14 between the downward position and the upward position is very slight, and in one embodiment is equal to 0.025 inches.

When the cam 16 is rotated clockwise about its axis Y within the bore 26 by the key K, the ramp 77 about the outer surface of the shaft 70 forces the movable detent 14 to its downward position (see FIG. 12), where the sinusoidal groove 64 aligns with the groove 56 in the slot 50. In this way, the selector detent pin P is free to move out of the throughbore 52 and out of the concave lower end 60 of the movable detent 14, through the groove 64, and along the groove 56 in the slot 50 to engage the depression 54 under bias from the spring S when the shaft 20 is rotated about the axis X by turning the lever arm 24. The depression 54 is deep enough to allow the spring S to bias the tip T of the selector detent pin P to snap into the depression 54 and to releasably hold the selector detent pin P thereat, but not so deep as to prevent the lever arm from rotating back about the axis X to move the selector detent pin P out of the depression 54. The ability of the selector detent pin P to move along the groove 56 in the slot 50 in turn allows the flat 23 of the shaft 20 to be rotated into alignment with the trigger arm A such that the trigger arm A can rotate upward in contact with the flat 23 and thereby place the firearm in its "FIRE" mode to allow the firearm to be fired. Hence, when the key K is rotated in clockwise to move the movable detent 14 to its downward position, the selector switch 10 is in an unlocked condition, and allows the user to freely select between the firearm's "SAFE" and "FIRE" modes.

Conversely, when the cam 16 is rotated counterclockwise about its axis Y within the bore 26 by the key K, the ramp 77 about the outer surface of the shaft 70 allows the spring S to force the movable detent 14 to its upward position (see FIG. 13), where sinusoidal groove 64 is no longer in alignment with the groove 56 in the slot 50. In this orientation, the tip T of the selector detent pin P is extended upward under bias from the spring S into the throughbore 52 such that the tip T is locked into position within and cannot move out of the throughbore 52. With the selector detent pin P locked in place in the throughbore 52, the shaft 20 cannot rotate. As can be seen from FIG. 5, in this orientation, the flat 23 of the shaft 20 is not engaged with the trigger arm A, and the trigger arm A is thereby in the position that will not allow the firearm to be fired, i.e. the "SAFE" mode. Hence, when the movable detent 14 is in its upward position and the selector detent pin P is aligned with the throughbore 52, the firearm will remain locked in the "SAFE" mode.

While we have described in the detailed description a single configuration that may be encompassed within the disclosed embodiments of this invention, numerous other alternative configurations, that would now be apparent to one of ordinary skill in the art, may be designed and constructed within the bounds of our invention as set forth in the claims. Moreover, the above-described novel lockable safety selector switch 10 of the present invention can be arranged in a number of other and related varieties of configurations without expanding beyond the scope of our invention as set forth in the claims.

For example, the firearm selector switch 10 of the present invention can be readily modified for ambidextrous use by attaching to or forming a second lever arm, opposite the lever arm 24, at the distal end 28 of the body 20 of the switch 10 such that the second lever arm is positioned outside the receiver R when the switch 10 is assembled in the receiver R. Similarly, switch 10 can alternately be configured with the lever arm 24 as a separate component that attaches to the shaft 20 with a screw or some other similar attaching device.

Additional variations or modifications to the configuration of the novel lockable safety selector switch 10 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of our invention.

What is claimed is:

1. A lockable safety selector switch configured to replace a manufacturer's original safety selector switch for a firearm having a selector detent pin, the lockable safety selector switch comprising:

a. a body configured to selectively rotate about an axis in the firearm directly between a SAFE position that prevents the firearm from firing and a FIRE position that allows the firearm to fire, the body defining a groove in a surface of the body, the groove being configured and oriented to slidingly receive at least a portion of the selector detent pin when the body rotates between the SAFE and FIRE positions;

b. a locking mechanism comprising a cam housed at least in part within the body, the cam engaging and selectively moving the selector detent pin between a first position in which the selector detent in does not prevent the rotation of the body and a second position in which at least a portion of the selector detent pin extends through the groove and into an opening in the body to prevent rotation of the body and thereby lock the body in the SAFE position;

wherein the lockable safety selector switch is configured such that the firearm requires no modification in order for the lockable safety selector switch to replace the original safety selector switch and operate to lock and unlock the switch.

2. The lockable safety selector switch of claim 1, wherein the locking mechanism comprises a movable detent movable between a first position and a second position, the movable detent engaging and selectively allowing at least a portion of the selector detent pin to enter the opening in the body to prevent rotation of the body and thereby lock the body in the SAFE position when the movable detent is in the detent first position.

3. The lockable safety selector switch of claim 2, wherein the movable detent retracts into a recess in the body when orienting from the detent second position to the detent first position.

4. The lockable safety selector switch of claim 3, wherein the body allows the selector detent pin to orient along the groove between a first pin position and a second pin position, and wherein the movable detent engages the selector detent pin at the first pin position when the movable detent is at the detent first position to selectively allow at least a portion of the selector detent pin to enter the recess to prevent rotation of the body and thereby lock the body in the SAFE position.

5. The lockable safety selector switch of claim 4, wherein the body and movable detent are configured such that when the movable detent is positioned at the detent first position, at least a portion of the selector detent pin engages the movable detent in the recess at a position below the bottom of the groove to restrain the selector detent pin from travel along the groove and to thereby prevent the body from rotation and lock the body in the SAFE position.

6. The lockable safety selector switch of claim 5, wherein when the selector detent pin selectively engages the movable detent at the detent second position, the selector detent pin is free to travel away from the movable detent along the groove and thereby allow the body to rotate to the FIRE position.

7. The lockable safety selector switch of claim 4, further comprising a biasing member that engages the selector detent pin to urge the selector detent pin toward the movable detent.

8. The lockable safety selector switch of claim 7, wherein the biasing member comprises a spring.

9. The lockable safety selector switch of claim 1, further comprising a biasing member that urges the selector detent pin toward the cam.

10. The lockable safety selector switch of claim 1, wherein the cam rotates within the body.

11. The lockable safety selector switch of claim 1, further comprising a key configured to lock and unlock the locking mechanism.

12. A lockable safety selector switch for a firearm comprising a safety selector detent pin, the switch comprising:

a. a body having a first end and a second end and an outer surface, the body having a selector lever attached to the first end; the body defining a cavity extending inwardly from the second end and a having a groove formed in the outer surface of the body proximate the second end; the groove being sized to receive the selector detent pin and extending part way about said outer surface of the body; the groove including a first end and a second end; the body defining a fixed detent at the first end of the groove and a bore at the second end of the groove; the bore being in communication with said cavity;

b. a cam positioned in the cavity; the cam comprising a disc having opposed upper and lower surfaces and a cam shaft extending from the lower surface; the cam shaft having a radial surface; the cam disc being sized to be rotatably positioned in the body cavity; the cam shaft being sufficiently long to extend across the bore at the second end of the groove in the outer surface of the body when the cam is positioned in the cavity; the disc upper surface defining a key receptacle, whereby when a key is received by the key receptacle, the cam can be rotated within the cavity by rotation of the key;

c. a movable detent positioned in the bore at the second end of the groove; the movable detent having an upper surface and a lower surface, the lower surface being concave; the moveable detent upper surface engaging the radial surface of the cam shaft; the lower surface of the detent engaging the selector detent pin; whereby the moveable detent translates axially in the bore between a first position and a second position in response to rotation of the cam; whereby, when the detent is in the first position, the concave surface of the movable detent is in alignment with the first end of the groove in the outer surface of the body and thereby allows the selector detent pin to travel between the first and second ends of the groove, such that the body can be rotated by the selector lever; and whereby when the moveable detent is in the second position, the selector detent pin extends through the groove into the bore, such that the body cannot be rotated; and d. a cap secured to the body to close the cavity; the cap defining a key hole in alignment with the key receptacle of the cam; the key hole being configured to enable a key to pass through the cap to engage the key receptacle; the cap being positionally fixed relative to the body.

13. The lockable safety selector switch of claim 12, wherein the key receptacle comprises a recess in the second surface of the cam disc, the recess configured to complementarily receive the end of the key that is configured to mate with the key receptacle.

14. The lockable safety selector switch of claim 12, wherein the body is generally cylindrical with a central axis.

15. The lockable safety selector switch of claim 14, wherein the body selectively rotates about the axis in the firearm between a SAFE position that prevents the firearm from firing and a FIRE position that allows the firearm to fire.

16. The lockable safety selector switch of claim 12, wherein the cap includes a second selector lever extending from the cap, the second selector lever configured to selectively rotate the switch body.

17. The lockable safety selector switch of claim 16, wherein the cap further includes an arrowhead formed on the cap opposite the lever.

18. In combination with a firearm originally equipped with an original safety selector switch configured to rotate in the firearm directly between a SAFE position that prevents the firearm from firing and a FIRE position that allows the firearm to fire and a movable safety selector detent pin that operatively engages the original safety selector switch, a lockable safety selector switch configured to replace the original safety selector switch, the lockable safety selector switch comprising:

a. a body configured to selectively rotate in the firearm directly between a SAFE position that prevents the firearm from firing and a FIRE position that allows the firearm to fire, the body defining a groove in a surface of the body, the groove being configured and oriented to slidingly receive at least a portion of the selector detent pin; and b. a locking mechanism comprising a cam housed at least in part within the body, the cam engaging and selectively moving the selector detent pin between a first position in which the selector detent pin does not prevent the rotation of the body and a second position in which at least a portion of the selector detent in extends through the groove and into an opening in the body to prevent rotation of the body and thereby lock the body in the SAFE position;

wherein the lockable safety selector switch is configured such that the firearm requires no modification for the lockable safety selector switch to replace the original safety selector switch and operate to lock and unlock the switch.

19. The combination of claim 18, wherein the body is configured to rotate within the firearm to orient between the SAFE and FIRE positions.

20. The combination of claim 18, wherein the locking mechanism comprises a movable detent movable in the locking mechanism between a first detent position and a second detent position, the movable detent operatively associated with the selector detent pin to selectively allow at least a portion of the selector detent pin to extend into the opening in the body when the movable detent is in the first detent position.

* * * * *

UNITED STATES PATENT AND TRADEMARK OFFICE

CERTIFICATE OF CORRECTION

PATENT NO. : 8,650,789 B2
APPLICATION NO. : 13/671158
DATED : February 18, 2014
INVENTOR(S) : Bruce Dionne et al.

It is certified that error appears in the above-identified patent and that said Letters Patent is hereby corrected as shown below:

In the Claims

In Column 7, line 40, after the word detent replace "in" with --pin--.

In Column 10, line 13, after the word detent replace "in" with --pin--.

Signed and Sealed this
Twenty-seventh Day of May, 2014

Michelle K. Lee

Michelle K. Lee
*Deputy Director of the United States Patent and Trademark Office*